US005251760A

United States Patent [19]

Smith et al.

[11] Patent Number: 5,251,760

[45] Date of Patent: Oct. 12, 1993

[54] SHIPPING PACKAGE

[75] Inventors: Jeffrey A. Smith, Plainfield; Herbert Aronowitz, Cranford, both of N.J.

[73] Assignee: Squire Corrugated Container Corp., Linden, N.J.

[21] Appl. No.: 18,440

[22] Filed: Feb. 16, 1993

[51] Int. Cl.[5] ..... B65D 85/30

[52] U.S. Cl. ..... 206/583; 206/594

[58] Field of Search ..... 206/521, 583, 586, 591, 206/594, 329, 453

[56] References Cited

U.S. PATENT DOCUMENTS

| | | | |
|---|---|---|---|
| 3,853,220 | 12/1974 | Luray | 206/583 X |
| 3,999,661 | 12/1976 | Jones | 206/591 |
| 4,285,432 | 8/1981 | de Villers et al. | 206/591 |
| 5,129,512 | 7/1992 | Garwood | 206/583 X |

*Primary Examiner*—Steven N. Meyers
*Assistant Examiner*—Jacob K. Ackun, Jr.
*Attorney, Agent, or Firm*—Kirschstein, Ottinger Israel & Schiffmiller

[57] ABSTRACT

A packaged article is captured between a resilient film mounted on a frame, and a raised, planar, stationary platform. The frame surrounds, and is positioned below, the plane of the platform in use.

10 Claims, 2 Drawing Sheets

SHIPPING PACKAGE

BACKGROUND OF THE INVENTION

1. Field of the Invention

This invention generally relates to a package for protecting an article from shipping and handling damage.

2. Description of Related Art

A shipping package must be able to withstand impact forces encountered during shipping and handling without transmitting excessive amounts of such forces to an article packaged therein. It is well known, for example, to package an article in a shipping container filled with such loose fill materials as foam, paper, wood chips, etc., or to cushion the article with an inflatable insert, or to support the article with rigid but deformable plastic inserts. It is also well known, for example from U.S Pat. Nos. 4,852,743 and 4,923,065 to sandwich an article between a pair of pliable, flexible membranes mounted on frames, thereby floatably suspending the article within the container.

Although the known packaging techniques are satisfactory for their intended purposes, experience has shown that there are many limitations in their practice. Thus, and by no means constituting an exhaustive list, foam is not readily recyclable or biodegradable; paper and wood chips put an ever-increasing burden on trees and the environment; inflatable inserts require sources of pressurized gas; and rigid but deformable inserts are not entirely satisfactory for delicate objects such as glass. Floating suspensions of the kind exemplified by the above patents either space the membrane-mounted frames apart, in which case, the membranes do not contact the entire outer periphery of the article; or allow the frames to contact each other, in which case, the membranes may exert insufficient tension on the article being packaged.

It is also known to sandwich articles between a single membrane-mounted frame and the bottom of a container. However, in practice, the position of the frame shifts during shipping and handling, thereby providing inadequate protection for the article. Also, an inadequate tension may be exerted on the packaged article by the membrane on the frame.

SUMMARY OF THE INVENTION

1. Objects of the Invention

It is a general object of this invention to advance the state of the art of packaging.

It is another object of this invention to limit the extent of shipping and handling impact forces being transmitted to a packaged article.

Another object of this invention is to reliably protect a fragile article from breakage during shipping and handling.

A further object of this invention is to exert a high tension on a packaged article without breaking the article itself.

Still another object of this invention is to completely enclose a packaged article to resist dust and contamination.

2. Features of the Invention

In keeping with these objects, and others which will become apparent hereinafter, one feature of this invention resides, briefly stated, in a package for protecting an article, which comprises a container having a base; and a raised stationary platform within the container for stationarily supporting an article positioned on the platform. The platform lies in a plane elevated above the base, and has a predetermined area.

The package further comprises a generally planar frame having an opening larger than said predetermined area. A resilient film is stretched over the opening and attached to the frame. The frame is mounted for movement within the container to a guard position in which the frame surrounds, and is positioned below the plane of, the platform. The film resiliently urges the article against the platform in the guard position.

The package still further comprises a holder for holding the frame in the guard position, especially during shipping and handling. In the preferred embodiment, the holder is a cover for closing the container.

In an advantageous embodiment, the container has a set of walls extending upwardly above the base, and the cover is hinged to one of these walls. The frame has a set of hinged flaps which respectively overlie the container walls during said movement. Preferably, one of the flaps is hinged to one of the container walls.

The platform itself is integrally formed from an insert having support portions which engage the base and the walls of the container. The container and the frame are integrally formed from a single sheet of corrugated board material. The film itself is preferably light-transmissive, but may be opaque, is adhered to the frame by glue or other suitable adhesive, and is a flexible, stretchable, elastomeric membrane which may be made from a resilient laminate, woven fabric, netting, vinyl, polyethylene, or puncturable elastomeric film.

In accordance with this invention, a high degree of tension is exerted on the article due to the positioning of the frame below the plane of the platform and in a surrounding relationship with the platform. The article is captured about the entire periphery of the platform, thereby providing a highly reliable, impact-resistant, cushioned support.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
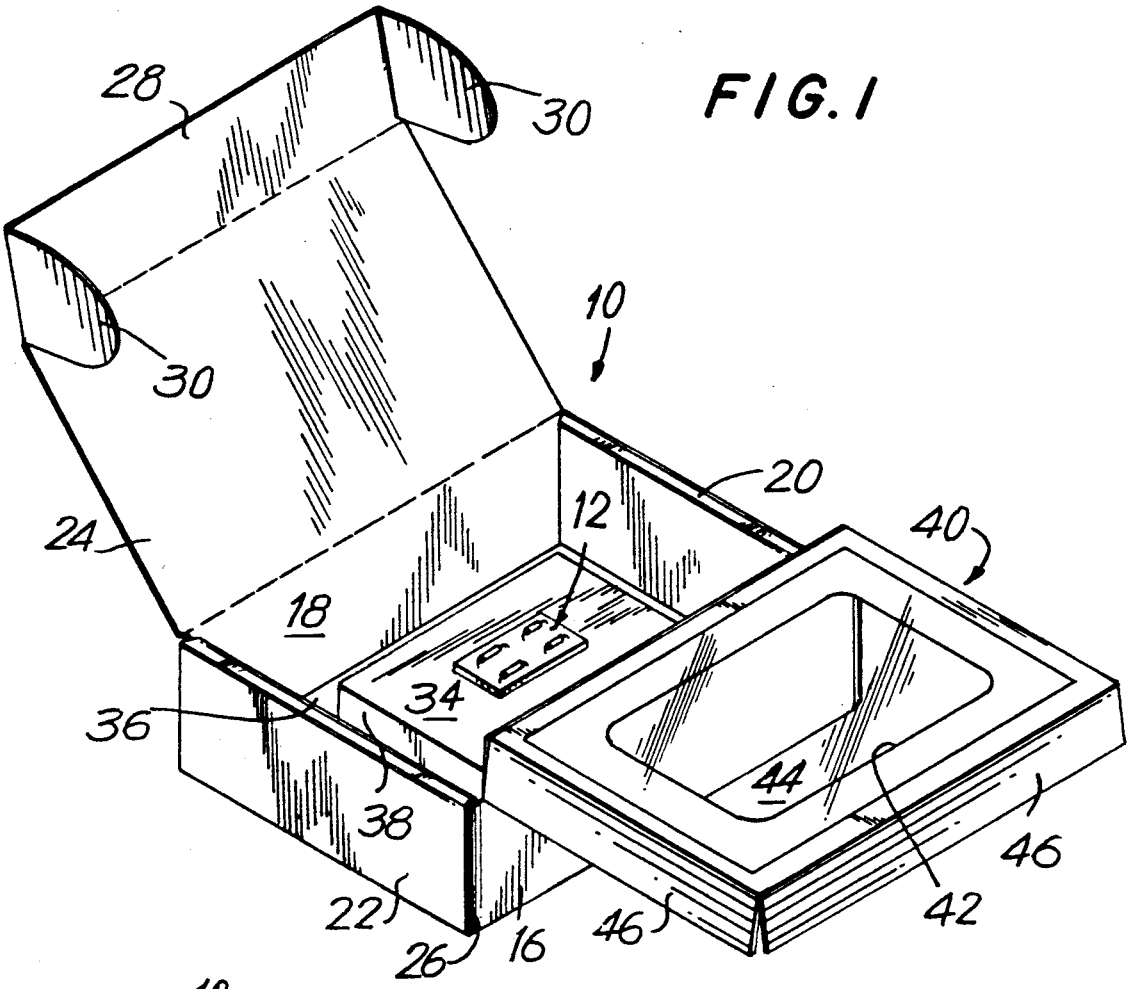
FIG. 1 is a perspective view of an open package for protecting an article according to this invention.

Referring now to the drawings, reference numeral 10 generally identifies a package for protecting an article 12 from damage and/or dust contamination. As illustrated, article 12 is a printed circuit board having electrical components thereon. This was done merely for ease of illustration. Virtually any article can be packaged in accordance with this invention.

Package 10 includes a container constituted of a corrugated board material, and having a generally planar rectangular base 14, a front wall 16, a rear wall 18, a pair of end walls 20, 22, and a cover 24. Front and rear walls 16, 18 are constituted by a single panel. End walls 20, 22 are constituted by a double fold panel, thereby defining forwardly-open front pockets 26 at opposite ends of the front wall 16. The cover 24 has a cover flap 28 and two end flaps 30. As illustrated, the container is open. When closed, the cover overlies the container, the cover flap 28 overlies the front wall 16, and the end flaps 30 are tucked into the pockets 26.

Figure 3:
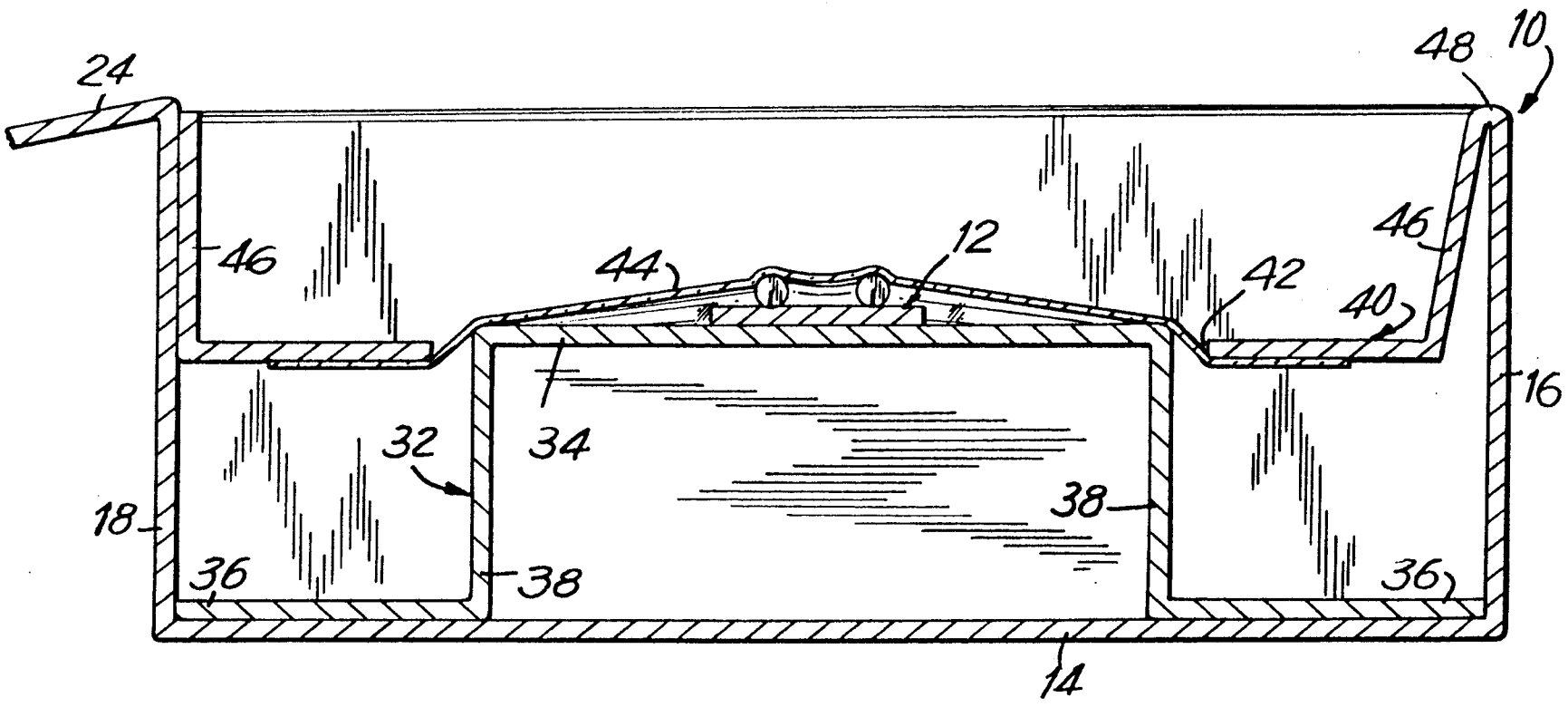
FIG. 3 is an enlarged, sectional view taken on line 3—3 of FIG. 2.

Package 10 also includes a discrete insert 32 also constituted of a corrugated board material and mounted within the container. As shown in FIG. 3, the insert 32 includes a generally rectangular, planar, raised, stationary platform 34 on which the article 12 is stationarily supported. The insert 32 include support portions 36 in direct contact with, and supported by, the base 14, and a set of upstanding support walls 38 extending upwardly from the support portions 36 to the platform 34 and operative for supporting the platform 34 at an elevation above the base 14.

A generally planar, rectangular frame 40 has an opening 42 having an area larger than the generally rectangular area of the platform 34. A resilient film 44 is stretched generally tautly over the opening 40, and is attached at its periphery to the frame. Preferably, the film 44 is adhered to the frame with a suitable adhesive. The film may be made from a resilient laminate, woven fabric, netting, vinyl, polyethylene, or puncturable elastomeric film. The film is preferably light-transmissive, but can equally well be opaque.

Figure 2:
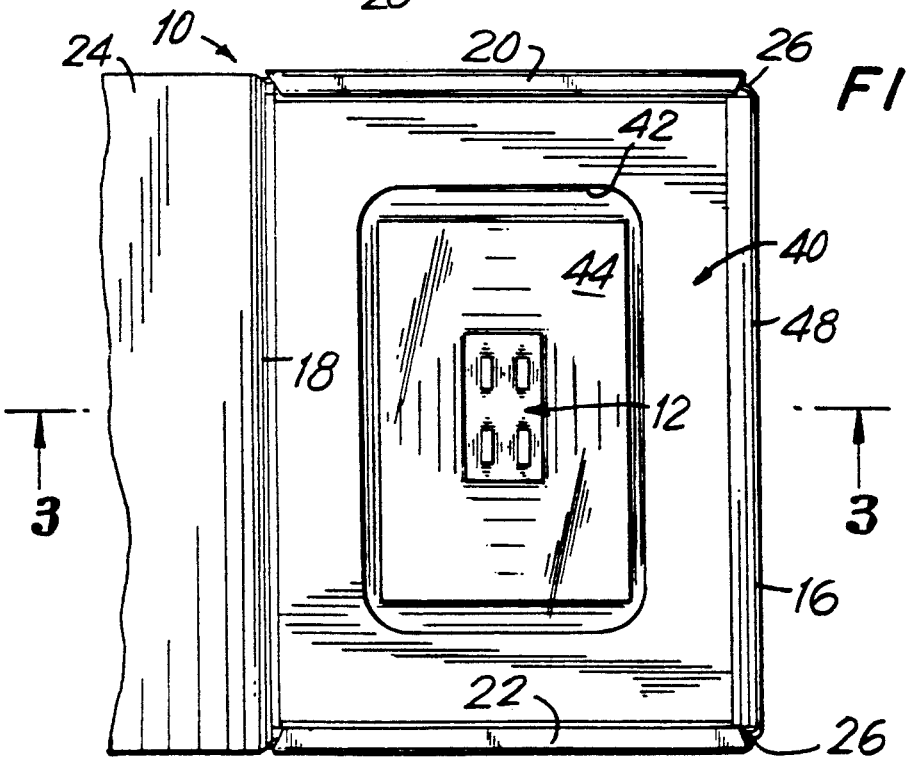
FIG. 2 is a broken-away, top plan view of the open package of FIG. 1.

The frame 40 includes a set of flaps 46 extending away from the plane of the frame. One of the flaps 46, as seen in FIG. 3, is pivotably mounted on the front wall 16 along a living hinge 48. Thus, the frame 40 with its attached film 44 may be pivoted from its open position shown in FIG. 1 in which the platform 34 is accessible and ready to receive the article 12, to its closed guard position shown in FIGS. 2 and 3 in which the frame 40 surrounds the platform 34 and is positiioned below the plane of the platform. Upon closing the cover 24 and tucking the end flaps 30 in the front pockets 26, the frame 40 is held in its guard positiion.

As best seen in FIG. 3, the film 44 resiliently contacts the upper surfaces of the article 12 and the entire periphery of the platform 34. The film resiliently presses the article 12 against the stationary platform. Being stationary, the platform does not move. Being located within the container, i.e., between the base 14 and cover 24, the platform 34 is positioned away from impact forces applied to the exterior walls of the container. Being located below the plane of the platform 34, the frame 40 exerts a high degree of tension on the article and insures that the article is firmly captured in place. The frame 40 is securely held in place by the cover 24, assisted by the relatively high degree of friction exerted by the flaps 46 on the container walls 18, 20, 22. Other means for holding the frame in place could include such fasteners as stapes or tape.

It will be understood that each of the elements described above, or two or more together, also may find a useful application in other types of constructions differing from the types described above.

While the invention has been illustrated and described as embodied in a shipping package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A package for protecting an article, comprising:

(a) a container having a base;

(b) a raised stationary platform within the container for stationarily supporting an article positioned on the platform, said platform lying in a plane elevated above the base and having a predetermined area;

(c) a generally planar frame having an opening larger than said predetermined area, and a resilient film stretched over the opening and attached to the frame, said frame being mounted for movement within the container to a guard position in which the frame surrounds, and is positioned below the plane of, the platform and in which the film resiliently contacts the article and resiliently urges the article against the platform; and (d) means for holding the frame in the guard position.

2. The package according to claim 1, wherein the container has walls extending above the base, and wherein the holding means is a cover hinged to one of the walls.

3. The package according to claim 1, wherein the container has walls extending above the base, and wherein the frame has flaps extending away from the frame, and wherein at least one of the flaps frictionally engages at least one of the walls of the container during said movement.

4. The package according to claim 3, wherein another of the flaps is hinged to another of the walls of the container.

5. The package according to claim 4, wherein the container and the frame are integrally formed from a single sheet of corrugated board material.

6. The package according to claim 1, wherein the container has walls extending above the base, and wherein the platform is integrally formed from an insert having support portions engaging the base and the walls of the container.

7. The package according to claim 1, wherein the predetermined area of the raised platform and the opening are generally rectangular.

8. The package according to claim 1, wherein the film is light-transmissive.

9. The package according to claim 1, wherein the film is adhered to the frame.

10. The package according to claim 1, wherein the film is a flexible, stretchable, elastomeric membrane.

* * * * *